US005595027A

United States Patent [19]

Vail

[11] Patent Number: 5,595,027

[45] Date of Patent: Jan. 21, 1997

[54] GUTTER PROTECTOR

[76] Inventor: R. Lane Vail, 1000 Reverdy La., Matthews, N.C. 28105

[21] Appl. No.: 341,638

[22] Filed: Nov. 17, 1994

[51] Int. Cl.[6] ..... E04D 13/00

[52] U.S. Cl. ..... 52/12; 52/11

[58] Field of Search ..... 52/12, 11, 13, 52/15

[56] References Cited

U.S. PATENT DOCUMENTS

| | | | |
|---|---|---|---|
| 3,550,381 | 12/1970 | South | 52/12 X |
| 4,586,298 | 5/1986 | Colp | 52/12 |
| 4,644,704 | 2/1987 | Pedgonay | 52/12 |
| 4,841,686 | 6/1989 | Rees | 52/12 |
| 4,905,427 | 3/1990 | McPhalen | 52/12 |
| 5,216,852 | 6/1993 | Bemis et al. | 52/12 |
| 5,406,754 | 4/1995 | Cosby | 52/12 |

FOREIGN PATENT DOCUMENTS

| | | | |
|---|---|---|---|
| 4011036 | 10/1991 | Germany | 52/12 |
| 4116219 | 11/1992 | Germany | 52/12 |

*Primary Examiner*—Wynn E. Wood
*Assistant Examiner*—Aimee E. McTigue
*Attorney, Agent, or Firm*—W. Thad Adams, III, P.A.

[57] ABSTRACT

A gutter protector for mounting in the open top of a gutter attached to the edge of a roof. The gutter protector includes an elongate sheet of flexible material for being flexed into a curved shape under tension and placed into the open top of the gutter while in the flexed condition. The shape and dimensions of the gutter retains the gutter protector in the flexed position in the gutter. The gutter protector has a curved outer surface extending upwardly above the opening of the gutter to define a debris-diverting surface. Two embodiments are disclosed. One embodiment uses a flange and the tension of the protector when bent into the gutter to hold it in place. In another embodiment, retainers clip onto the lips of the gutter to hold the protector in place. Holes in the sheet of flexible material permit water to pass through the protector into the gutter. A filter is positioned on an inner surface of the sheet material in registration with the aperture means for preventing small debris particles from passing through the holes into the gutter.

14 Claims, 5 Drawing Sheets

GUTTER PROTECTOR

TECHNICAL FIELD AND BACKGROUND OF THE INVENTION

This invention relates to a gutter protector of the type for being mounted in a conventional rainwater gutter attached to the edge of a roof. Such conventional gutters are commonly used on sloping shingled roofs and similar structures. The invention of this application discloses a gutter protector which is inexpensive to manufacture and simple to install with simple tools such as metal shears. The gutter protector does not require permanent attachment to the house or gutter, and is therefore simple to remove for cleaning or replacement. The gutter protector also effectively permits free flow of water from the roof into the gutter while ejecting trash and debris off of the roof onto the ground below.

Illustrative of the prior art is U.S. Pat. No. 4,937,986 to applicant et al, which discloses a gutter protector which is nailed to the roof below the next-to-the-last row of shingles and just above the gutter. The gutter is preformed and slopes over the gutter. It includes a series of alternating perforated and non-perforated sections which are angled with respect to each other and to the roof and gutter so as to encourage water to flow through the perforations and the trash to be swept off of the roof.

The gutter protector of the '986 Patent has a relatively complex shape, and requires bending up the shingles so that it can be nailed to the roof. The invention according to this application avoids these and other problems.

SUMMARY OF THE INVENTION

Therefore, it is an object of the invention to provide a gutter protector which is simple to manufacture.

It is another object of the invention to provide a gutter protector which is simple to install on the gutter.

It is another object of the invention to provide a gutter protector which can be installed with simple tools.

It is another object of the invention to provide a gutter protector which is installed without nailing or other attachment to the roof.

It is another object of the invention to provide a gutter protector which permits free passage of water into the gutter which effectively excluding debris.

These and other objects of the present invention are achieved in the preferred embodiments disclosed below by providing a gutter protector for mounting in the open top of a gutter attached to the edge of a roof. The gutter protector includes an elongate sheet of flexible material for being flexed into a curved shape under tension and placed into the open top of the gutter while in the flexed condition. The shape and dimensions of the gutter retains the gutter protector in the flexed position in the gutter. The gutter protector has a curved outer surface extending upwardly above the opening of the gutter to define a debris-diverting surface. Flange means are positioned on the sheet material and extend outwardly from the surface of the sheet material for being trapped and retained in a lip proximate a top edge of the gutter for providing positive retention of the gutter protector in the gutter. Aperture means in the sheet of flexible material permit water to pass through the protector into the gutter. Filter means are positioned on an inner surface of the sheet material in registration with the aperture means for preventing small debris particles from passing through the aperture means into the gutter.

According to one preferred embodiment of the invention, the sheet of flexible material comprises extruded vinyl.

According to another preferred embodiment of the invention, the sheet of flexible material comprises extruded vinyl having a thickness of between one-eighth and three-sixteenths inch.

According to yet another preferred embodiment of the invention, the filter means comprises a strip of tangled mesh fiberglass.

According to yet another preferred embodiment of the invention, the fiberglass strip is at least five times the thickness of the sheet of flexible material.

According to yet another preferred embodiment of the invention, the fiberglass strip includes adhesive attachment means for attaching the fiberglass strip to the inner surface of the sheet material.

According to yet another preferred embodiment of the invention, the aperture means comprise at least three rows of holes extending along the length of the gutter protector.

According to yet another preferred embodiment of the invention, the rows of holes are staggered in offset relation to adjacent rows.

According to yet another preferred embodiment of the invention, the holes are elongated in the lengthwise direction of the gutter protector.

Preferably, the holes are one inch long and one-quarter inch wide.

According to yet another preferred embodiment of the invention, the flange means comprises an elongate flange integrally formed on the outer surface of the sheet of flexible material.

According to yet another preferred embodiment of the invention, the rows of holes and the holes are spaced the same distance apart.

According to yet another preferred embodiment of the invention, the sheet of flexible material is coated with an ultraviolet protective coating to reduce ultraviolet degradation.

According to another preferred embodiment of the invention, a gutter protector is provided for being mounted in the open top of a gutter attached to the edge of a roof. The gutter protector includes an elongate sheet of flexible material for being flexed into a curved shape under tension and placed into the open top of the gutter while in the flexed condition and retainer means positioned on opposing ends of the sheet material and extending outwardly from the surface of the sheet material for being trapped and retained in respective lips proximate opposing top edges of the gutter. The retainer means provide positive retention of the gutter protector in the gutter. Aperture means in the sheet of flexible material permit water to pass through the protector into the gutter. Filter means are positioned on an inner surface of the sheet material in registration with the aperture means for preventing small debris particles from passing through the aperture means into the gutter.

According to another preferred embodiment of the invention, the sheet of flexible material is formed of extruded vinyl and includes a filter means holder positioned on the inner surface of the sheet material for receiving and holding the filter means.

According to yet another preferred embodiment of the invention, filter means comprises a strip of tangled mesh fiberglass.

According to yet another preferred embodiment of the invention, the aperture means comprise at least three rows of holes extending along the length of the gutter protector, the rows of holes being staggered in offset relation to adjacent rows.

According to yet another preferred embodiment of the invention, the holes are elongated in the lengthwise direction of the gutter protector.

According to yet another preferred embodiment of the invention, the holes are one inch long and one-quarter inch wide.

According to yet another preferred embodiment of the invention, the rows of holes and the holes are spaced the same distance apart.

According to yet another preferred embodiment of the invention, the sheet of flexible material is coated with an ultraviolet protective coating to reduce ultraviolet degradation.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENTS AND BEST MODE

Figure 1:
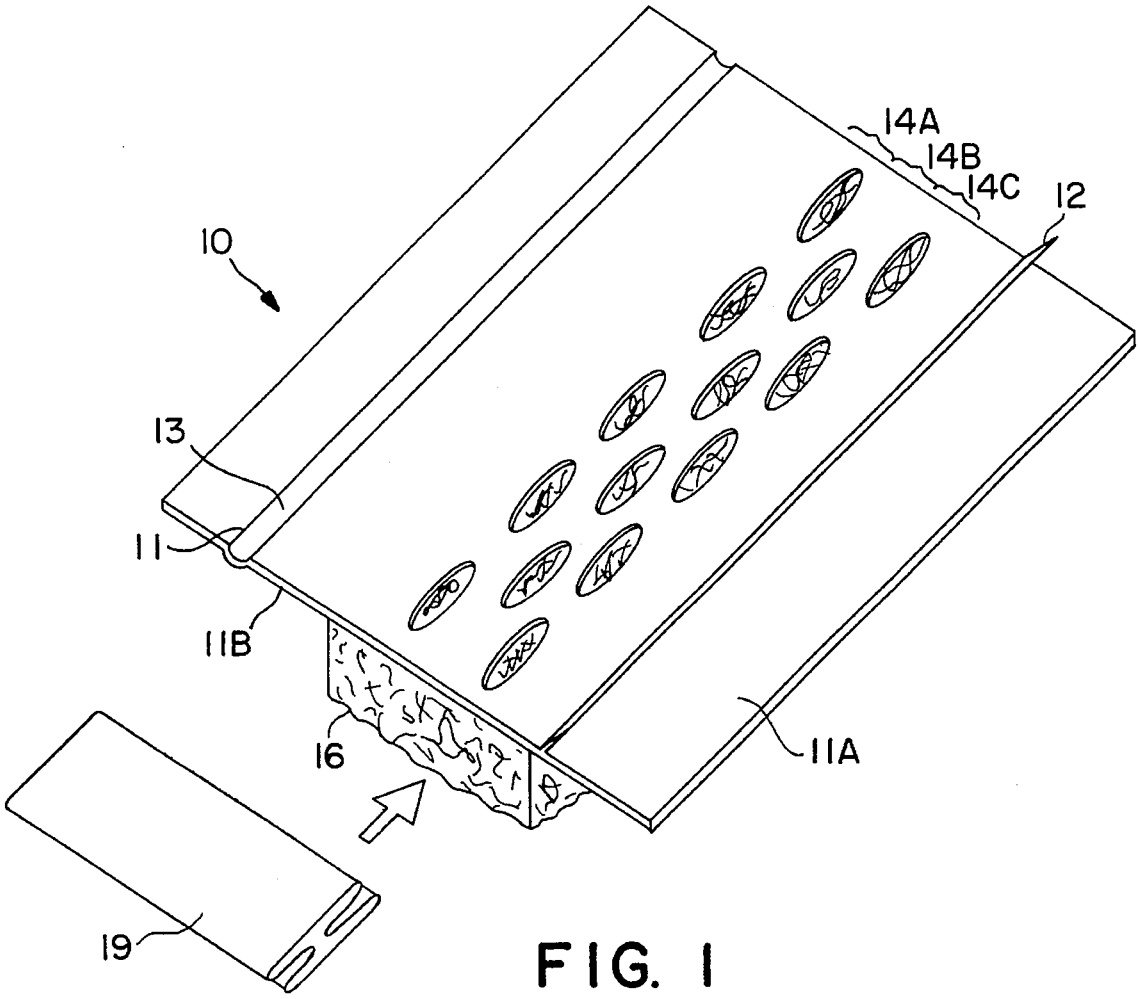
FIG. 1 is a perspective view of a length of the gutter protector according to a preferred embodiment of the invention.

Referring now specifically to the drawings, a gutter protector 10 according to the present invention is illustrated in FIG. 1 and shown generally at reference numeral 10. The gutter protector 10 is formed of s sheet of extruded vinyl 11 of a suitable thickness, such as from ⅛th inch to 3/16ths inch. The sheet of vinyl is preferably extruded and is sufficiently flexible to enable it to be easily flexed and bent into a configuration where the sheet 11 is U-shaped. The sheet 11 includes an integrally-formed flange 12 which extends outwardly from the outer surface 11A of sheet 11. The flange 12 is approximately one inch long and one-eighth inch thick at its base. The sheet 11 is nine inches wide when used on a conventional gutter. Sheet 11 may be extruded and used in any length, but a conventional use would be for the gutter protector 10 to be two feet long. This length would be easy for one person to install. Longer lengths could be used, but might require two or more persons to install.

Sheet 11 also includes several rows of holes 14A, 14B, 14C which are positioned in staggered relation to adjacent rows, as shown in FIG. 1. The number of rows of holes can vary, but it is believed that three rows of holes will function adequately to permit adequate water flow into the gutter. In a preferred embodiment, the holes are one inch long and one-quarter inch wide. The individual holes in each row are one-quarter inch apart, and the rows of holes 14A, 14B, and 14C are one-quarter inch apart from the adjacent row.

Sheet 11 also includes a small channel 13 formed on the top surface. The channel may vary in size, but would typically be about ¼" deep and ¼" wide, and is intended to trap very small gravel with which asphalt shingles are usually coated. The gravel can be removed during regular cleaning.

A block of tangled mesh fiberglass 16 is adhered by, for example, hot melt adhesive, to the inner surface 11B. The mesh fiberglass 16 is positioned with relation to the rows of holes 14A, 14B, and 14C so that water cannot pass through the holes 14A, 14B, and 14C without passing through the mesh fiberglass 16.

The mesh fiberglass may vary in thickness, but may be between one-quarter and five-eights inch thick. The material used in air conditioning filters is suitable for this purpose.

Adjacent segments of the gutter protector 10 are held in alignment by a clip 19, which is secured to respective adjacent edges. Clip 19 is formed of thin plastic and is flexible enough to bend easily as the gutter protectors 10 are installed. They provide a finished, neat appearance to the installation since they keep all of the segments of the gutter protector 10 at the same level.

Figure 2:
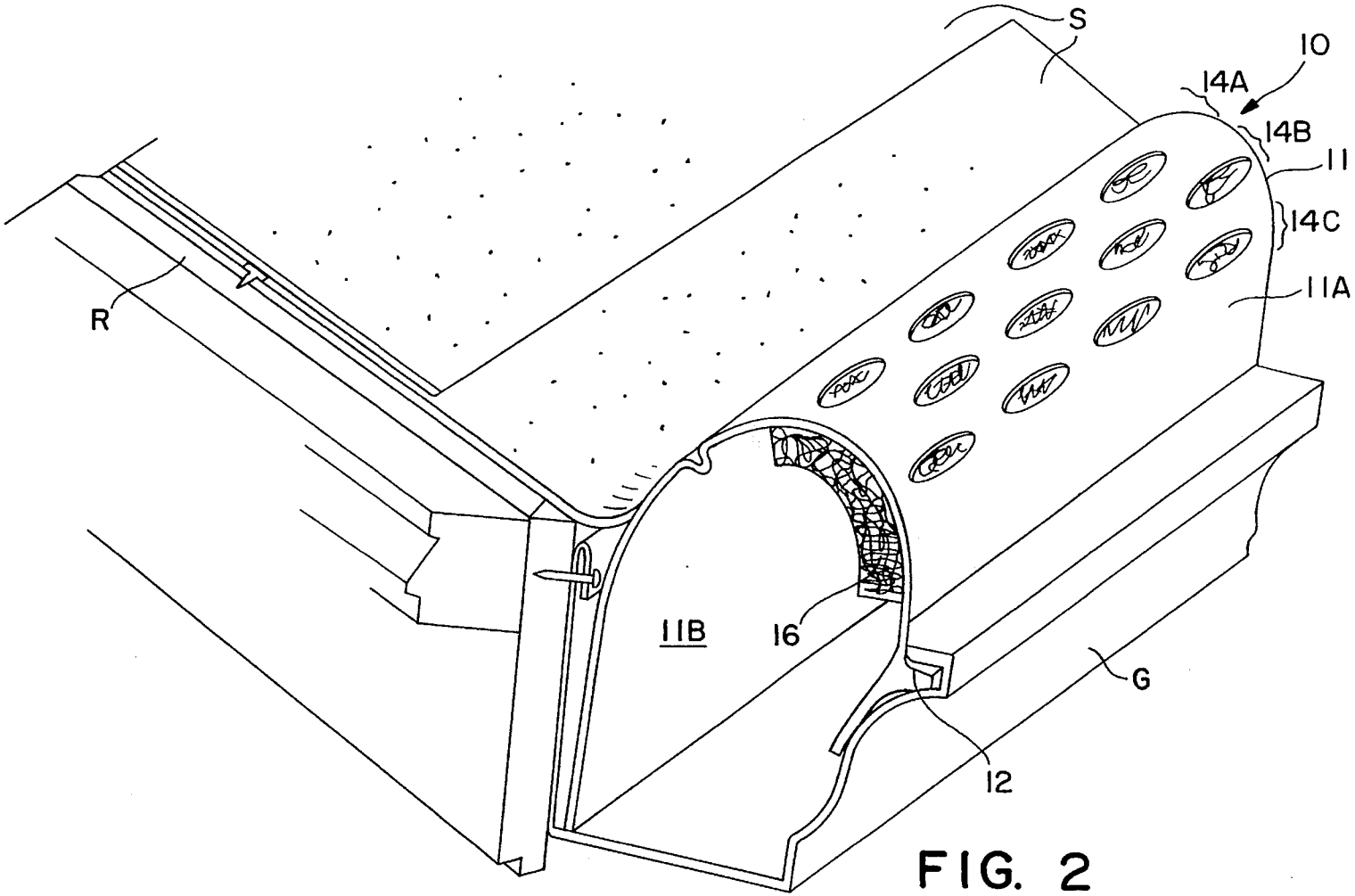
FIG. 2 is a perspective view of a length of the gutter protector installed in a gutter.

Referring now to FIG. 2, the gutter protector 10 is shown installed in a gutter "G" which is nailed to the edge of a roof "R", which is covered by overlapping shingles "S". The sheet 11 is flexed to a degree sufficient to permit it to be placed into the gutter "G", with opposite ends of the gutter protector 10 extending downwardly into the front and back ends of the gutter "G". The very edge of the last shingle "G" on the roof is bent upwardly to the extent necessary to flex over the rearward side of the gutter protector 10. The shingle "G" forms a curve which acts as a seal to prevent water from running off of the roof "R" directly into the gutter "G", holds the rear edge of the gutter protector 10 in the gutter "G", and acts as a ramp to direct the water upwardly towards the uppermost part of the gutter protector 10.

When placed in the gutter "G", the flange 12 of the gutter protector 10 snaps into the front lip of the gutter "G" and holds the front edge of the gutter protector 10 in the gutter "G". No adhesive, nails or other attachment means are required. The gutter protector 10 is securely held in the gutter "G" only by the edge of the shingle "S" and the flange 12 in the lip of the gutter "G".

The sheet 11 is curved and forms a convex dome-like profile which permits water to be pushed up from the shingle "G" to the top, where is passes through the holes in rows 14A, 14B, 14C. At the same time, the water carries with it debris, such as dirt, leaves, twigs and other material, which is swept up over the top of the gutter protector 10 and over the front of the gutter "G" and onto the ground. The holes are large enough to permit the water to fall into the gutter "G", while the mesh fiberglass, which lies up against the holes on the inner surface 11B of the sheet 11, helps prevent the debris from being either trapped in the holes, or passing through the holes into the gutter "G".

Removal or repair of the gutter protector 10 is accomplished simply by compressing the sheet 11 enough to remove the flange 12 from the lip of the gutter "G". The flex in the sheet 11 will cause the gutter protector 10 to resume at least some of its original configuration. After cleaning the gutter protector 10 is reinstalled as described above. The gutter protector 10 is formed of s sheet of extruded vinyl 11 of a suitable thickness, such as from ⅛th inch to 3/16ths inch. The sheet of vinyl is preferably extruded and is sufficiently flexible to enable it to be easily flexed and bent into a configuration where the sheet 11 is U-shaped. The sheet 11 includes an integrally-formed flange 12 which extends outwardly from the outer surface 11A of sheet 11. The flange 12 is approximately one inch long and one-eighth inch thick at its base. The sheet 11 is approximately nine inches wide when used on a conventional gutter. Sheet 11 may be extruded and used in any length, but a conventional use would be for the gutter protector 10 to be two feet long, as described above with reference to gutter protector 10. A sufficient number of the gutter protectors 10 would be placed side-by-side along the length of the gutter to provide complete protection.

Figure 3:
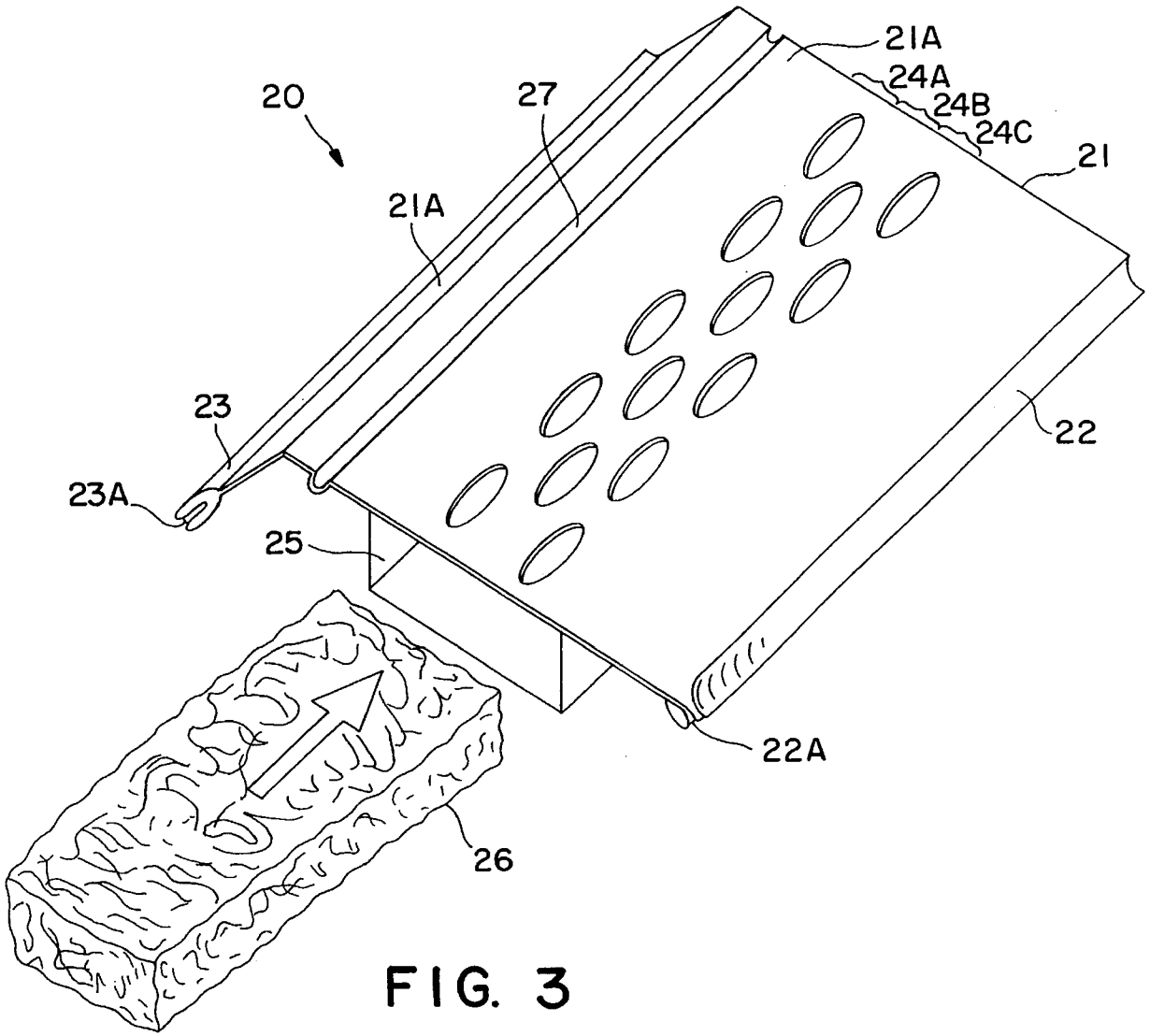
FIG. 3 is a perspective view of another embodiment of a gutter protector.

Referring now to FIG. 3, another preferred embodiment of the gutter protector is disclosed. Gutter protector 20 is formed of s sheet of extruded vinyl 21 of a suitable thickness, such as from ⅛th inch to 3/16ths inch. The sheet of vinyl is preferably extruded and is sufficiently flexible to enable it to be easily flexed and bent into a configuration where the sheet 21 is convex. Sheet 21 is creased adjacent its rear side to form a panel 21A angled at an approximate angle of 100° to the major segment of the sheet 21. Panel 21A is between 3/16" and ¼" thick and between 1–2 inches wide.

Sheet 21 also includes a small channel 27 formed on the top surface. The channel may vary in size, but would typically be about ¼" deep and ¼" wide, and is intended to trap very small gravel with which asphalt shingles are usually coated. The gravel can be removed during regular cleaning.

The sheet 21 includes an integrally-formed clip 22 which extends outwardly from an outer surface 21B of sheet 21. The clip 22 is approximately one-half inch long and has a quarter-inch slot 22A which fits over the front lip of the gutter.

Figure 5:
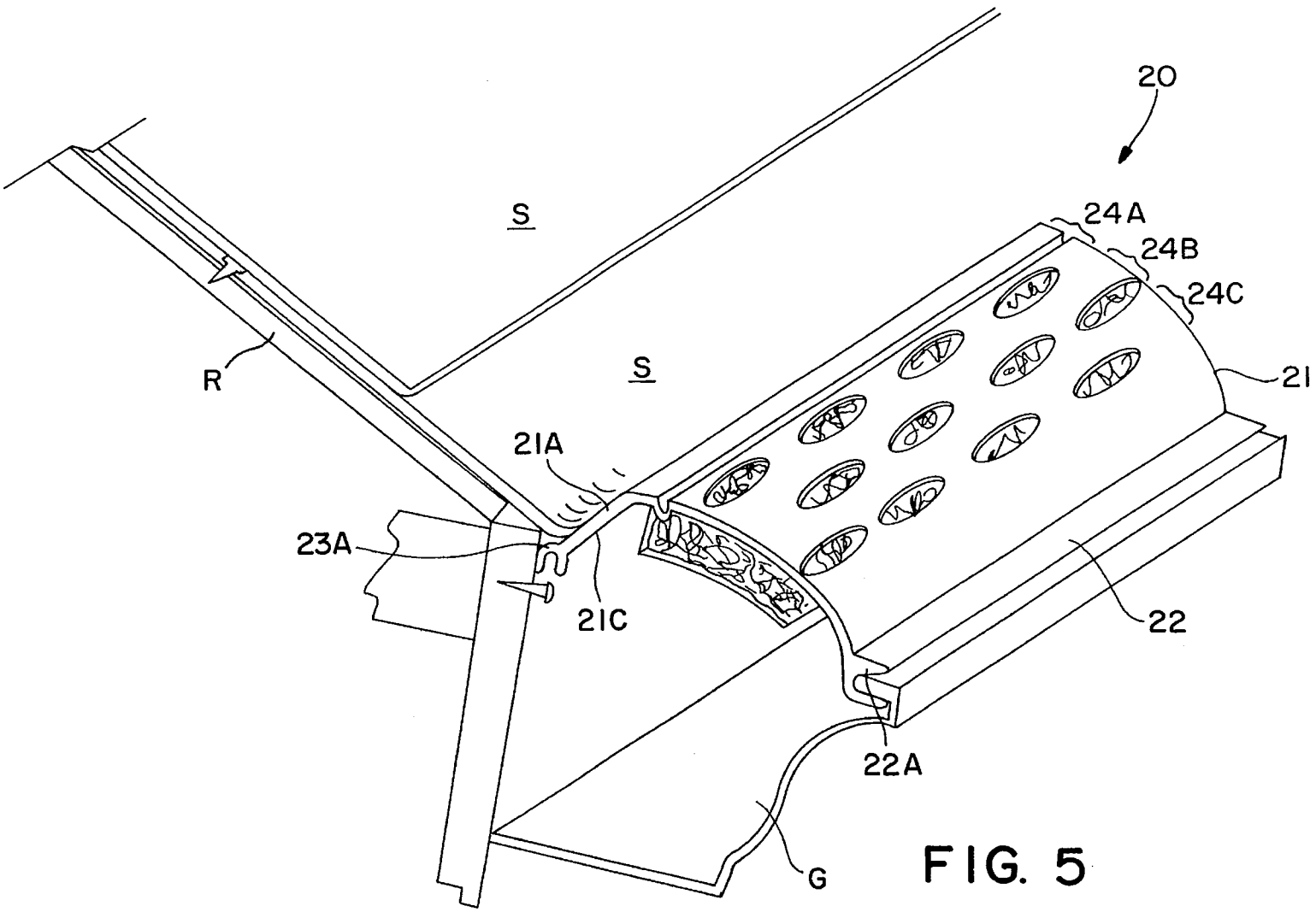
FIG. 5 is a perspective view of a length of the gutter protector installed in a gutter.

Another integrally-formed clip 23 extends outwardly from the opposite side of the sheet 21. Clip 23 is approximately one-half inch long and has a one-eighth inch slot 23A and fits over the inner lip of the gutter next to the soffit of the building to which it is attached. The attachment of the two clips 22 and 23 is best shown in FIG. 5.

The sheet 21 is six and one-half inches wide as used on a conventional gutter. Sheet 21 may be extruded and used in any length, but a conventional use would be for the gutter protector 20 to be two feet long. This length would be easy for one person to install. Longer lengths could be used, but might require two or more persons to install.

Sheet 21 also includes several rows of holes 24A, 24B, 24C which are positioned in staggered relation to adjacent rows, as shown in FIG. 3. The number of rows of holes can vary, but it is believed that three rows of holes will function adequately to permit adequate water flow into the gutter. In a preferred embodiment, the holes 24A, 24B, 24C are one inch long and one-quarter inch wide. The individual holes in each row are one-quarter inch apart, and the rows of holes 24A, 24B, and 24C are one-quarter inch apart from the adjacent row.

Figure 4:
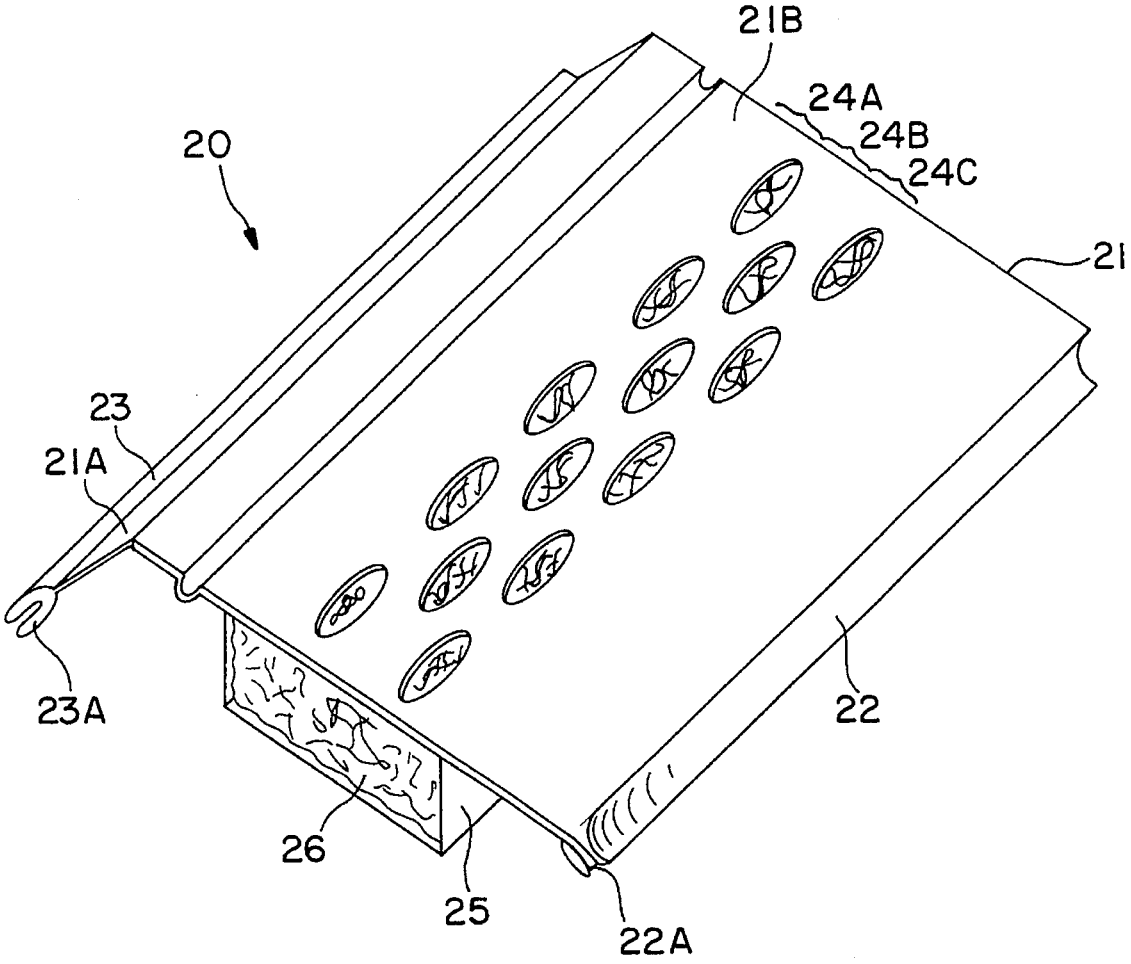
FIG. 4 is a perspective view according to FIG. 3, showing the filter in place.

An elongate filter retainer 25 is integrally molded onto the inner surface 21C of the sheet 21. Filter retainer 25 defines a rectangular void in communication with the rows of holes 24A, 24B, and 24C, as is shown in FIGS. 3 and 4. The filter retainer 25 receives and holds a block of tangled mesh fiberglass 26. The mesh fiberglass 26 is thus positioned with relation to the rows of holes 24A, 24B, and 24C so that water cannot pass through the holes 24A, 24B, and 24C without also passing through the mesh fiberglass 26 before entering the gutter itself. The mesh fiberglass may vary in thickness, but may be between one-half and one-inch thick, as noted above. See FIGS. 3 and 4.

Referring now to FIG. 5, the gutter protector 20 is shown installed in a gutter "G" which is nailed to the edge of a roof "R", which is covered by overlapping shingles "S". The sheet 21 is flexed to a degree sufficient to permit it to be placed into the gutter "G", with opposite ends of the gutter protector 20 extending towards the respective front and back ends of the gutter "G". The very edge of the last shingle "G" on the roof is bent upwardly to the extent necessary to flex over the rearward side of the gutter protector 20. The shingle "G" forms a curve which acts as a seal to prevent water from running off of the roof "R" directly into the gutter "G" and acts as a ramp to direct the water upwardly towards the uppermost part of the gutter protector 20.

When placed in the gutter "G", the clip 22A of the gutter protector 20 snaps onto the front lip of the gutter "G" and holds the front edge of the gutter protector 20 in the gutter "G". The clip 23A of the gutter protector 20 snaps onto the rear lip of the gutter "G" and holds the rear edge of the gutter protector 20 in the gutter "G". No adhesive, nails or other attachment means are required. The gutter protector 20 is securely held in the gutter "G" only by the edge of the shingle "S" and the flange 22 in the lip of the gutter "G".

The panel 21A of the sheet 20 extends upwardly from the rear edge of the gutter and forms a convex dome-like profile which permits water to be pushed up from the shingle "G" to the top, where is passes through the holes in rows 24A, 24B, 24C. At the same time, the water carries with it debris, such as dirt, leaves, twigs and other material, which is swept up over the top of the gutter protector 20 and over the front of the gutter "G" and onto the ground. The holes are large enough to permit the water to fall into the gutter "G", while the mesh fiberglass 26, which lies up against the holes on the inner surface 21C of the sheet 21, prevents the debris from being either trapped in the holes, or passing through the holes into the gutter "G".

Removal or repair of the gutter protector 20 is accomplished simply by compressing the sheet 21 enough to remove the force the clips 22A and 23A from the front and rear lips of the gutter "G". The flex in the sheet 21 will cause the gutter protector 20 to resume at least some of its original configuration. The mesh fiberglass 26 is replaced by pulling it from the filter retainer 25 and replacing it with a fresh length of mesh fiberglass 26. After cleaning the gutter protector 20 is reinstalled as described above.

A gutter protector is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A gutter protector mounted in an open top of a gutter attached to an edge of a roof, said gutter protector comprising:

(a) an elongate sheet of flexible material for being flexed into a curved shape under tension and for being placed into the open top of the gutter while in the flexed condition, for retaining the gutter protector in the flexed position in the gutter, the gutter protector having a curved, convex outer surface extending upwardly above the opening of the gutter to define a debris-diverting surface;

(b) first flange means positioned on the sheet material and extending outwardly from an outer edge of the sheet material for being trapped and retained in a lip proximate a top outer edge of the gutter for providing positive retention of the outer edge of the sheet material in the gutter;

(c) second flange means positioned on the sheet material and extending from an inner edge of the sheet material for being trapped and retained by an inner edge of the gutter adjacent the open top of the gutter and adjacent the edge of the roof to which the gutter is attached for providing positive retention of the inner edge of the sheet material in the gutter adjacent its open top; and (d) aperture means in the sheet of flexible material for permitting water to pass through the protector into the gutter.

2. A gutter protector according to claim 1, and including filter means positioned on an inner surface of said sheet material in registration with said aperture means for preventing small debris particles from passing through the aperture means into the gutter.

3. A gutter protector according to claim 2, wherein said filter means comprises a strip of tangled mesh fiberglass.

4. A gutter protector according to claim 3, wherein said fiberglass strip is at least five times the thickness of the sheet of flexible material.

5. A gutter protector according to claim 3, wherein said fiberglass strip includes adhesive attachment means attaching said fiberglass strip to the inner surface of the sheet material.

6. A gutter protector according to claim 1, wherein said first and second flange means are integrally formed on said sheet material.

7. A gutter protector according to claim 1, wherein said sheet of flexible material comprises extruded vinyl.

8. A gutter protector according to claim 1, wherein said sheet of flexible material comprises extruded vinyl having a thickness of between one-eighth and three-sixteenths inch.

9. A gutter protector according to claim 1, wherein said aperture means comprise at least three rows of holes extending along the length of the gutter protector.

10. A gutter protector according to claim 9, wherein said rows of holes are staggered in offset relation to adjacent rows.

11. A gutter protector according to claim 10, wherein said holes are elongated in the lengthwise direction of the gutter protector.

12. A gutter protector according to claim 10, wherein said holes are one inch long and one-quarter inch wide.

13. A gutter protector according to claim 9, wherein the rows of holes and the holes are spaced the same distance apart.

14. A gutter protector according to claim 1, wherein said sheet of flexible material is coated with an ultraviolet protective coating to reduce ultraviolet degradation.

* * * * *